US006815648B2

(12) United States Patent
Badami et al.

(10) Patent No.: US 6,815,648 B2
(45) Date of Patent: Nov. 9, 2004

(54) CONTACT SENSOR ARRANGEMENTS FOR GLASS-CERAMIC COOKTOP APPLIANCES

(75) Inventors: Vivek V. Badami, Schenectady, NY (US); Venkat Subramaniam Venkataramani, Clifton Park, NY (US); Emilie Thorbjorg Saulnier, East Greenbush, NY (US); Ertugrul Berkcan, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/334,591

(22) Filed: Dec. 31, 2002

(65) Prior Publication Data

US 2004/0164067 A1 Aug. 26, 2004

(51) Int. Cl.[7] ..... H05B 3/68; H05B 1/02

(52) U.S. Cl. ..... 219/494; 219/446.1

(58) Field of Search ..... 219/490, 491, 219/494, 495, 509, 510, 518, 446.1, 447.1, 448.4, 448.12, 448.13, 466.1, 461.1

(56) References Cited

U.S. PATENT DOCUMENTS

| | | | | |
|---|---|---|---|---|
| 3,710,076 | A | * | 1/1973 | Frazier ..... 219/448.17 |
| 4,740,664 | A | | 4/1988 | Payne et al. |
| 5,227,610 | A | * | 7/1993 | Schultheis et al. ..... 219/445.1 |
| 5,389,764 | A | | 2/1995 | Nishii et al. |
| 5,397,873 | A | * | 3/1995 | Stoops et al. ..... 219/448.12 |
| 6,111,228 | A | | 8/2000 | Berkcan et al. |
| 6,133,552 | A | | 10/2000 | Saulnier et al. |
| 6,155,711 | A | * | 12/2000 | Schaupert et al. ..... 374/1 |
| 6,184,501 | B1 | * | 2/2001 | Zapf ..... 219/447.1 |
| 6,242,721 | B1 | * | 6/2001 | Borrmann et al. ..... 219/518 |
| 6,492,622 | B2 | * | 12/2002 | Melson et al. ..... 219/452.11 |
| 6,501,054 | B2 | * | 12/2002 | Engelmann et al. ..... 219/518 |
| 6,538,238 | B1 | | 3/2003 | Berkcan et al. |

* cited by examiner

*Primary Examiner*—Sang Paik
(74) *Attorney, Agent, or Firm*—Pierce Atwood; Kevin M. Farrell

(57) ABSTRACT

A glass-ceramic cooktop appliance having at least one burner assembly disposed under a glass-ceramic plate. The cooktop appliance includes a sensor assembly having a support bar mounted on the burner assembly adjacent to the glass-ceramic plate and one or more devices for sensing cooktop related properties mounted on the support bar so as to be in contact with the glass-ceramic plate.

24 Claims, 6 Drawing Sheets

CONTACT SENSOR ARRANGEMENTS FOR GLASS-CERAMIC COOKTOP APPLIANCES

BACKGROUND OF THE INVENTION

This invention relates generally to glass-ceramic cooktop appliances and more particularly to contact sensing approaches for such appliances.

The use of glass-ceramic plates as cooktops in cooking appliances is well known. Such cooking appliances (referred to herein as glass-ceramic cooktop appliances) typically include a number of heating units mounted under the glass-ceramic plate and a controller for controlling the power applied to the heating units. The glass-ceramic plate presents a pleasing appearance and is easily cleaned in that the smooth, continuous surface prevents spillovers from falling onto the heating units underneath the cooktop.

In one known type of glass-ceramic cooktop appliance, the glass-ceramic plate is heated by radiation from a heating unit, such as an electric coil or a gas burner, disposed beneath the plate. The glass-ceramic plate is sufficiently heated by the heating unit to heat utensils upon it primarily by conduction from the heated glass-ceramic plate to the utensil. Another type of glass-ceramic cooktop appliance uses a heating unit that radiates substantially in the infrared region in combination with a glass-ceramic plate that is substantially transparent to such radiation. In these appliances, a utensil placed on the cooktop is heated primarily by radiation transmitted directly from the heating unit to the utensil, rather than by conduction from the glass-ceramic plate. Such radiant glass-ceramic cooktops are more thermally efficient than other glass-ceramic cooktops and have the further advantage of responding more quickly to changes in the power level applied to the heating unit. Yet another type of glass-ceramic cooktop appliance inductively heats utensils placed on the cooking surface. In this case, the energy source is an RF generator that emits RF energy when activated. The utensil, which comprises an appropriate material, absorbs the RF energy and is thus heated.

In each type of glass-ceramic cooktop appliances, provision must be made to avoid overheating the glass-ceramic plate. For most glass-ceramic materials, the operating temperature should not exceed 600–700° C. for any prolonged period. Under normal operating conditions, the temperature of the glass-ceramic plate will generally remain below this limit. However, conditions can occur during operation that can cause this temperature limit to be exceeded. Commonly occurring examples include operating the appliance with a small load or no load (i.e., no utensil) on the cooking surface, using badly warped utensils that make uneven contact with the cooking surface, and operating the appliance with a shiny and/or empty utensil.

To protect the glass-ceramic from extreme temperatures, glass-ceramic cooktop appliances ordinarily have some sort of temperature sensing device that can cause the heating unit to be shut down if high temperatures are detected. In addition to providing thermal protection, such temperature sensors can be used to provide temperature-based control of the cooking surface and to provide a hot surface indication, such as a warning light, after a burner has been turned off. Temperature sensing can also be used to detect other cooktop related properties such as the presence or absence of a utensil on the cooktop, the temperature, size or type of utensil on the cooktop, or properties, such as boiling state, of the utensil contents.

One common approach to sensing temperature in glass-ceramic cooktop appliances is to place a temperature sensor directly on the underside of the glass-ceramic plate. With this approach, however, the temperature sensor is subject to the high burner temperatures and thus more susceptible to failure. Furthermore, direct contact sensors are normally in the form of traces that are pasted directly to the underside of the glass-ceramic plate. Pasting traces to the glass-ceramic plate is a difficult, expensive process, and if a trace fails in any manner, the entire glass-ceramic plate needs to be replaced. In light of these issues, most cooktop sensor configurations in use today employ an optical sensor assembly that "looks" at the glass-ceramic surface from a remote location to detect the temperature and other cooktop properties. While remote optical sensing generally functions well, it typically requires guide optics that add to the overall cost of the sensor assembly.

Accordingly, it would be desirable to have effective and cost efficient glass-ceramic sensing arrangements that utilize direct contact sensors.

BRIEF SUMMARY OF THE INVENTION

The above-mentioned need is met by the present invention, which provides a glass-ceramic cooktop appliance having at least one burner assembly disposed under a glass-ceramic plate. The cooktop appliance includes a sensor assembly having a support bar mounted on the burner assembly adjacent to the glass-ceramic plate and a means for sensing cooktop related properties mounted on the support bar so as to be in contact with the glass-ceramic plate.

The present invention and its advantages over the prior art will become apparent upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
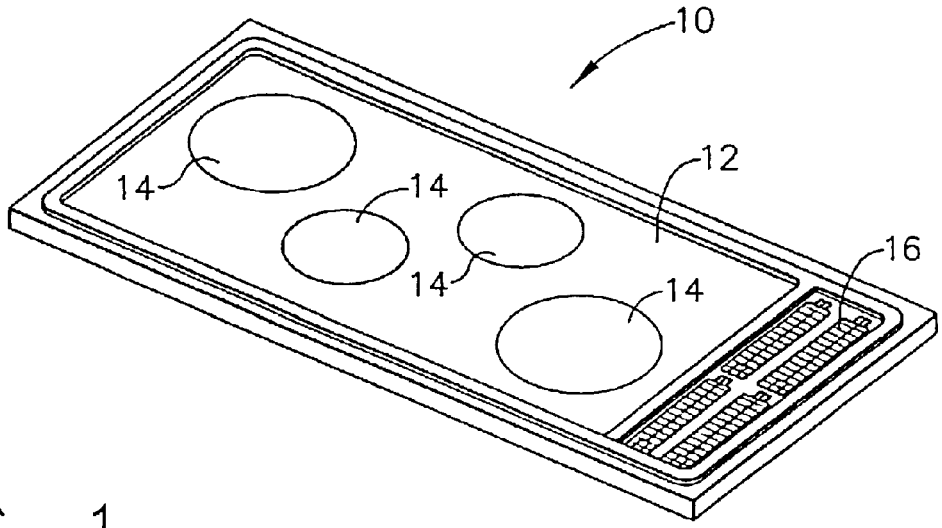
FIG. 1 is a perspective view of a glass-ceramic cooktop appliance.

Referring to the drawings wherein identical reference numerals denote the same elements throughout the various views, FIG. 1 shows a glass-ceramic cooktop appliance 10 having a glass-ceramic plate 12 that provides a cooking surface. The appliance 10 can be any type of cooktop appliance including a range having an oven and a cooktop provided thereon or a built-in cooktop unit without an oven. Circular patterns 14 formed on the cooking surface of the plate 12 identify the positions of each of a number (typically, but not necessarily, four) of burner assemblies (not shown in FIG. 1) located directly underneath the plate 12. A control panel 16 is also provided. As is known in the field, the control panel 16 includes knobs, touch pads or the like that allow an operator of the appliance 10 to individually control the temperature of the burner assemblies.

Figure 2:
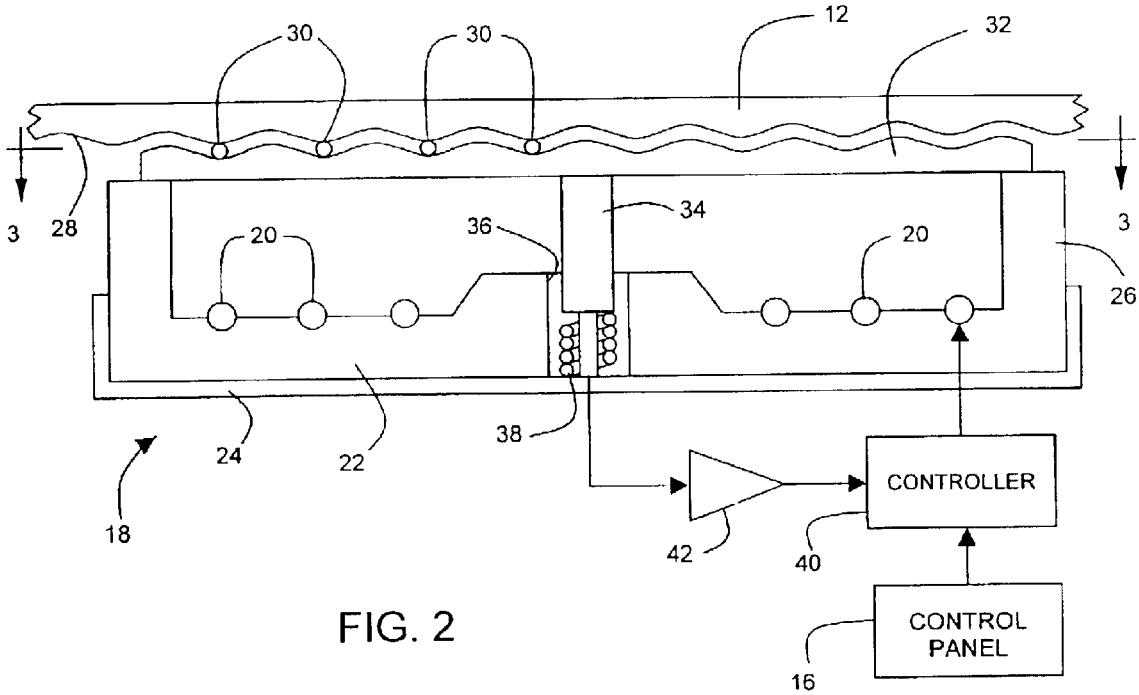
FIG. 2 is a partly schematic, sectional view of a burner assembly having a first contact sensing configuration.
Figure 3:
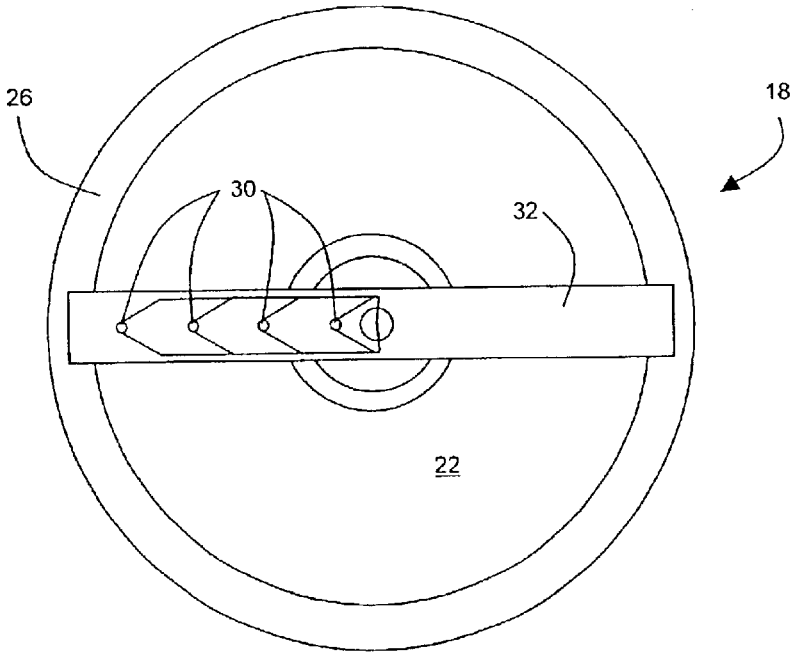
FIG. 3 is a sectional view of the burner assembly taken along line 3—3 of FIG. 2.

Turning to FIGS. 2 and 3, an exemplary one of the burner assemblies, designated generally by reference numeral 18, is shown located beneath the glass-ceramic plate 12. The burner assembly 18 includes a controllable energy source 20 in the form of an open coil electrical resistance element, which is designed when fully energized to radiate primarily in the infrared region of the electromagnetic energy spectrum. It should be noted that another type of energy source, such as an RF generator, could be used in place of the resistance element. The energy source 20 is arranged in an effective heating pattern such as a concentric coil and is secured to the base of an insulating liner 22 which is supported in a sheet metal support pan 24 The insulating liner 22 includes an annular, upwardly extending portion 26 that serves as an insulating spacer between the energy source 20 and the glass-ceramic plate 12. The support pan 24 is supported by conventional support means (not shown) for locating the burner assembly 18 in the desired position relative to the underside 28 of the glass-ceramic plate 12.

A plurality of discrete point temperature sensing elements 30, such as thermocouples, is provided to detect one or more characteristics relating to the cooktop appliance 10 (referred to herein as "cooktop related properties"), such as the temperature of the glass-ceramic plate 12, the presence or absence of a utensil on the cooktop, the temperature, size or type of utensil on the cooktop, or the properties or state of the utensil contents. The temperature sensing elements 30 are pressed against the underside 28 of the glass-ceramic plate 12 by a support bar 32. The support bar 32 is mounted to the burner assembly 18, adjacent to the underside 28 of the glass-ceramic plate 12, so that the temperature sensing elements 30 are disposed between the support bar 32 and the underside 28 of the glass-ceramic plate 12. The support bar 32 is preferably made of the same glass-ceramic material as the plate 12 or of a material that has the same or similar thermal coefficient of expansion as the glass-ceramic plate 12.

As seen in FIG. 2, the support bar 32 is supported by a hollow cylinder 34, which is attached to the under side of the support bar 32 at a central position thereof. The hollow cylinder 34 is disposed in an opening 36 formed in the center of the insulating liner 22 and is biased upward by compression spring 38. The spring 38 forces the hollow cylinder 34, and hence the support bar 32, toward the glass-ceramic plate 12, thereby pressing the temperature sensing elements 30 against the underside 28 of the glass-ceramic plate 12 so as to ensure good thermal contact therewith. It should be noted that this is just one possible arrangement for mounting the support bar 32; many other configurations are possible. Also, the support bar 32 need not span the entire burner assembly 18, as shown in FIGS. 2 and 3; alternative geometries are possible.

The underside 28 of the glass-ceramic plate 12 is shown in FIG. 2 as being dimpled. Glass-ceramic plates used in cooktop appliances are commonly dimpled because dimpling increases the structural strength of the plate and facilitates handling of the plate during its manufacture. Dimpling also diffuses light so as to enhance the plate aesthetically. The topside of the support bar 32 is dimpled accordingly to match the underside 28 of the glass-ceramic plate 12. Non-dimpled glass-ceramic plates and support bars can also be used.

Although four temperature sensing elements 30 are shown in FIGS. 2 and 3 by way of example, the present invention is not so limited. The exact number of temperature sensing elements 30 is dependent on the temperature sensing resolution desired for a particular application. The radial location of the temperature sensing elements 30 can be determined on where it is most desirable to sense the glass temperature. For example, depending on the burner type, there is typically a repeatable region within the burner area where glass temperatures tend to be higher than average. Temperature sensing elements can be concentrated in such regions to best protect the glass-ceramic plate from reaching temperatures exceeding the design margin. Also, the temperature sensing elements 30 are generally disposed on only one side of the support bar 32, although temperature sensing elements could be used on both sides of the support bar 32.

Leads from the temperature sensing elements 30 can be brought out from the burner assembly interior through the hollow center of the cylinder 34. The output from the temperature sensing elements 30 is fed to a controller 40, which is a common element used in most glass-ceramic cooktop appliances, via a voltage gain amplifier 42 and an analog-to-digital interface (not shown). In addition to other operations, the controller 40 controls the power level of the energy source 20 in response to the user selected settings entered via the control panel 16.

Figure 4:
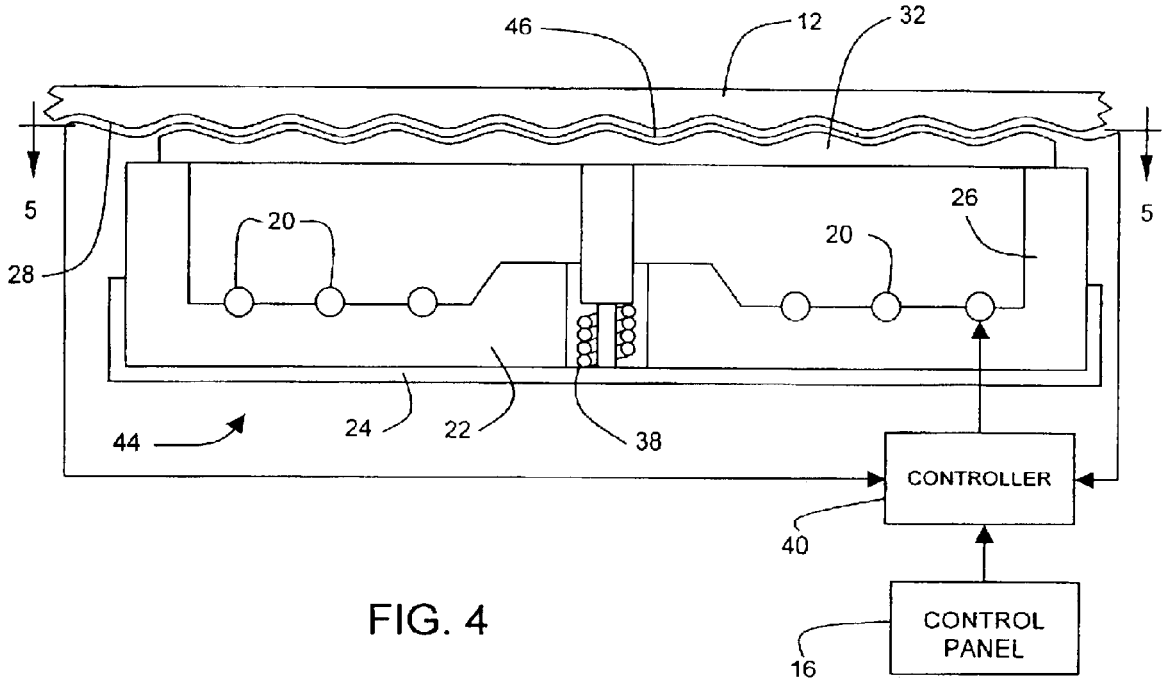
FIG. 4 is a partly schematic, sectional view of a burner assembly having a second contact sensing configuration.
Figure 5:
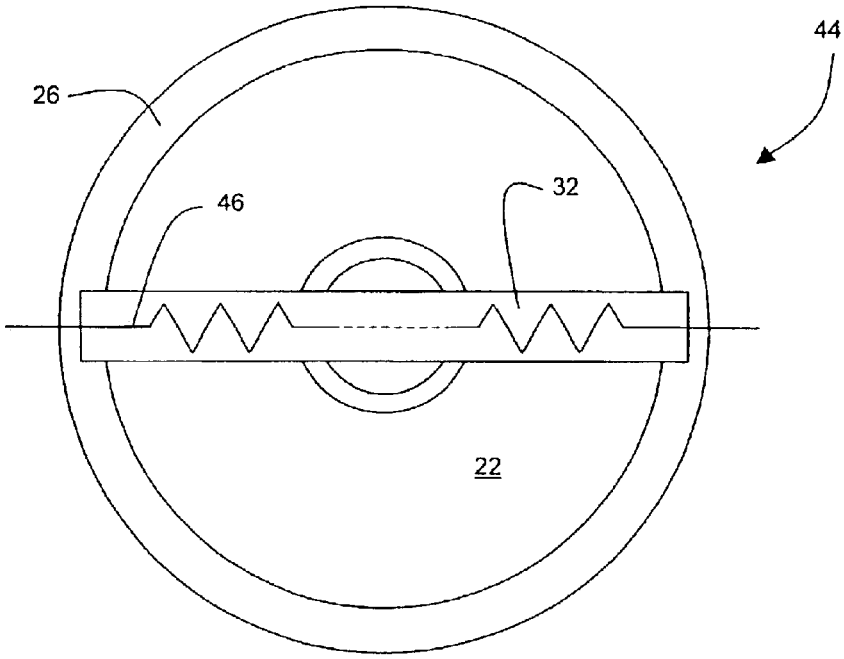
FIG. 5 is a sectional view of the burner assembly taken along line 5—5 of FIG. 4.

Turning to FIGS. 4 and 5, a second embodiment of a burner assembly 44 is shown located beneath the glass-ceramic plate 12. The burner assembly 44 is similar to the burner assembly of the first embodiment in that it includes a controllable energy source 20 secured to the base of an insulating liner 22 which is supported in a sheet metal support pan 24. Instead of a plurality of discrete point temperature sensing elements, however, the burner assembly 44 includes a single length of a resistance temperature device (RTD) element 46 provided to detect one or more cooktop related properties of the cooktop appliance 10 (as previously mentioned, these properties can include temperature of the glass-ceramic plate 12, the presence or absence of a utensil on the cooktop, the temperature, size or type of utensil on the cooktop, or the properties or state of the utensil contents). The RTD element 46 is made of a suitable material such as platinum, and the resistance of the element 46 is linearly proportional to its temperature over a wide operating range.

The RTD element 46 is pressed against the underside 28 of the glass-ceramic plate 12 by a support bar 32. As in the first embodiment, the support bar 32 is mounted to the burner assembly 18, under the glass-ceramic plate 12, so that the RTD element 46 is disposed between the support bar 32 and the underside 28 of the glass-ceramic plate 12 to ensure good thermal contact. The support bar 32 and its support structure are essentially the same as that described above in connection with the first embodiment, so a detailed description will not be repeated here.

Leads from the two ends of the RTD element 46 are brought out the sides of the burner assembly 44 and are connected to a controller 40, which is a common element used in most glass-ceramic cooktop appliances, via a standard RTD interface (not shown). The measurement of temperature using the RTD element 46 can be one of several standard methods including a simple voltage divider arrangement or a more sophisticated resistance bridge circuit.

Figure 6:
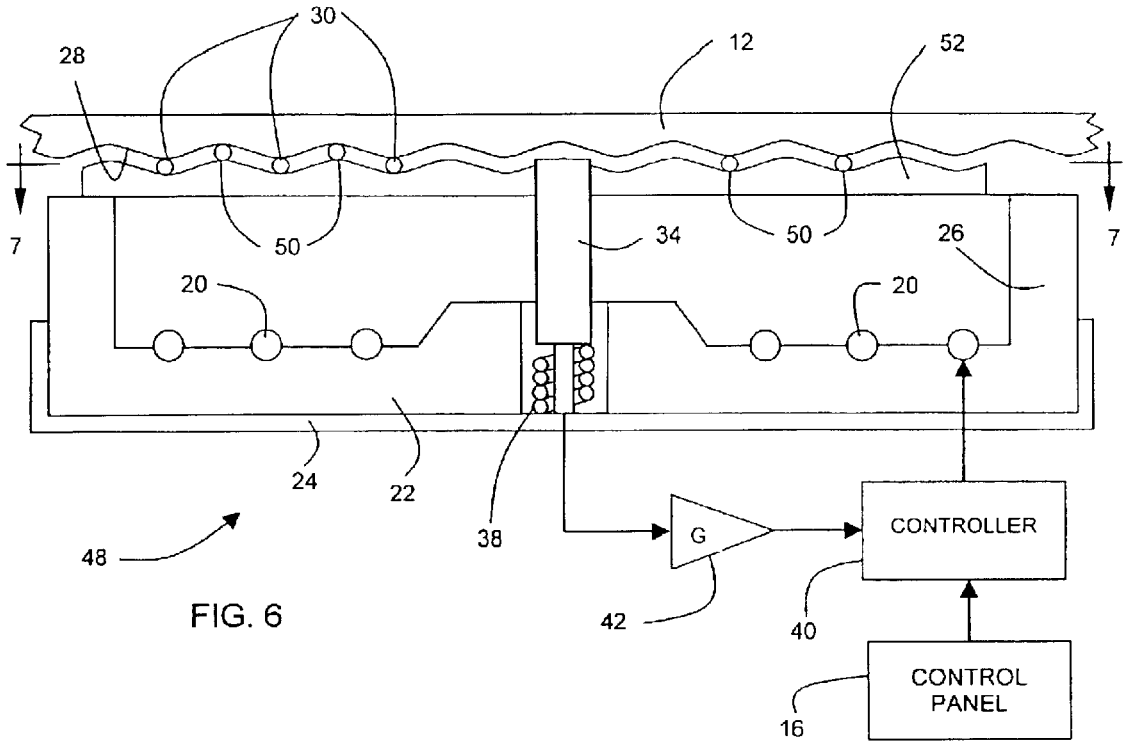
FIG. 6 is a partly schematic, sectional view of a burner assembly having a third contact sensing configuration.
Figure 7:
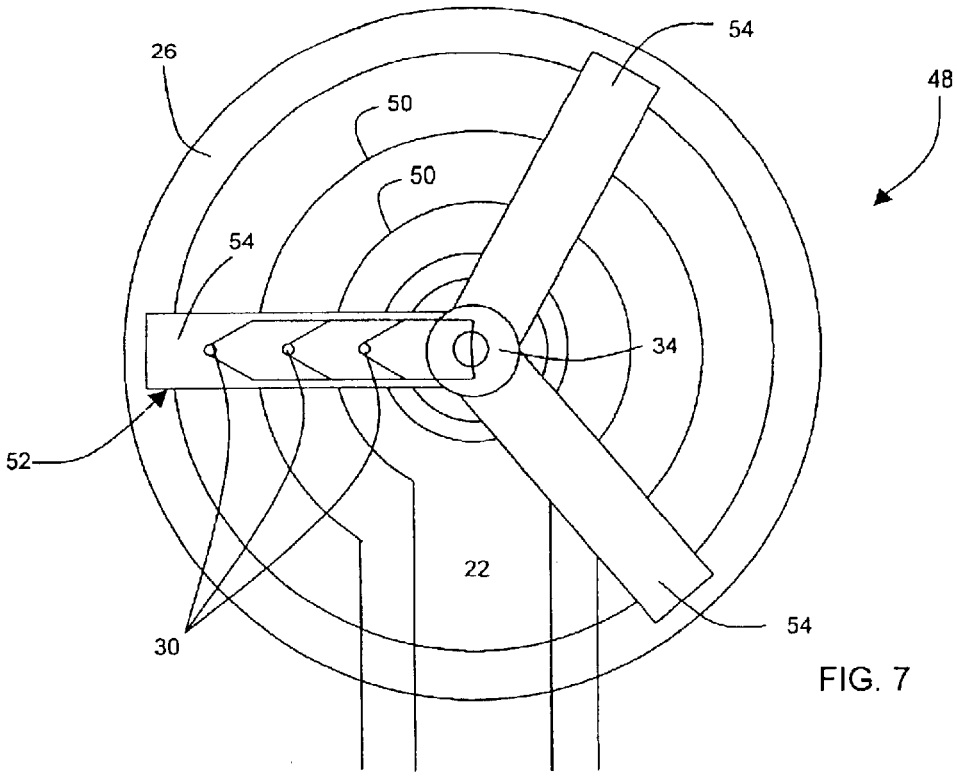
FIG. 7 is a sectional view of the burner assembly taken along line 7—7 of FIG. 6.

Turning now to FIGS. 6 and 7, a third embodiment of a burner assembly 48 is shown located beneath the glass-ceramic plate 12. The burner assembly 48 is similar to the burner assemblies of the first two embodiments in that it includes a controllable energy source 20 secured to the base of an insulating liner 22 which is supported in a sheet metal support pan 24. The third embodiment differs by providing a plurality of discrete point temperature sensing elements 30, such as thermocouples, in combination with one or more coils 50 that can function as inductive and temperature sensing elements. The temperature sensing elements 30 and coils 50 can be used together to detect one or more characteristics relating to the cooktop appliance. Alternatively, the coils 50 could be combined with one or more RTD elements instead of temperature sensing elements. Although two coils 50 are shown in FIGS. 6 and 7 by way of example, the present invention is not so limited. The exact number of coils 50 is dependent on the temperature sensing resolution desired for a particular application. The radial locations of the coils 50 can be determined on where it is most desirable to sense the glass temperature and/or other cooktop related properties.

The coils 50 are wire loops supported against the underside 28 by a support bar 52 to ensure good thermal contact. In particular, portions of the coils 50 are disposed between the support bar 52 and the underside 28 of the glass-ceramic plate 12. To better support the circular coils, the support bar 52 has three equally spaced spokes 54 radiating outward from a cylinder 34. It should be noted that more than three spokes could be used. The temperature sensing elements 30 are pressed against the underside 28 of the glass-ceramic plate 12 by one of the spokes 54. An alternative configuration could include temperature sensing elements or RTDs mounted on each spoke 54. The support bar 52 is preferably made of the same glass-ceramic material as the plate 12 or of a material that has the same or similar thermal coefficient of expansion as the glass-ceramic plate 12. The support bar support structure is essentially the same as that described above in connection with the first embodiment, so a detailed description will not be repeated here.

As an alternative, the coils 50 could be comprised of metallic traces deposited on the underside 28 of the glass-ceramic plate 12 instead of wire loops supported by the support bar 52. The trace material can be any suitable material, several of which are known in the field including oxides of Ruthenium, noble metals such as platinum, gold and silver, and alloys thereof.

Figure 8:
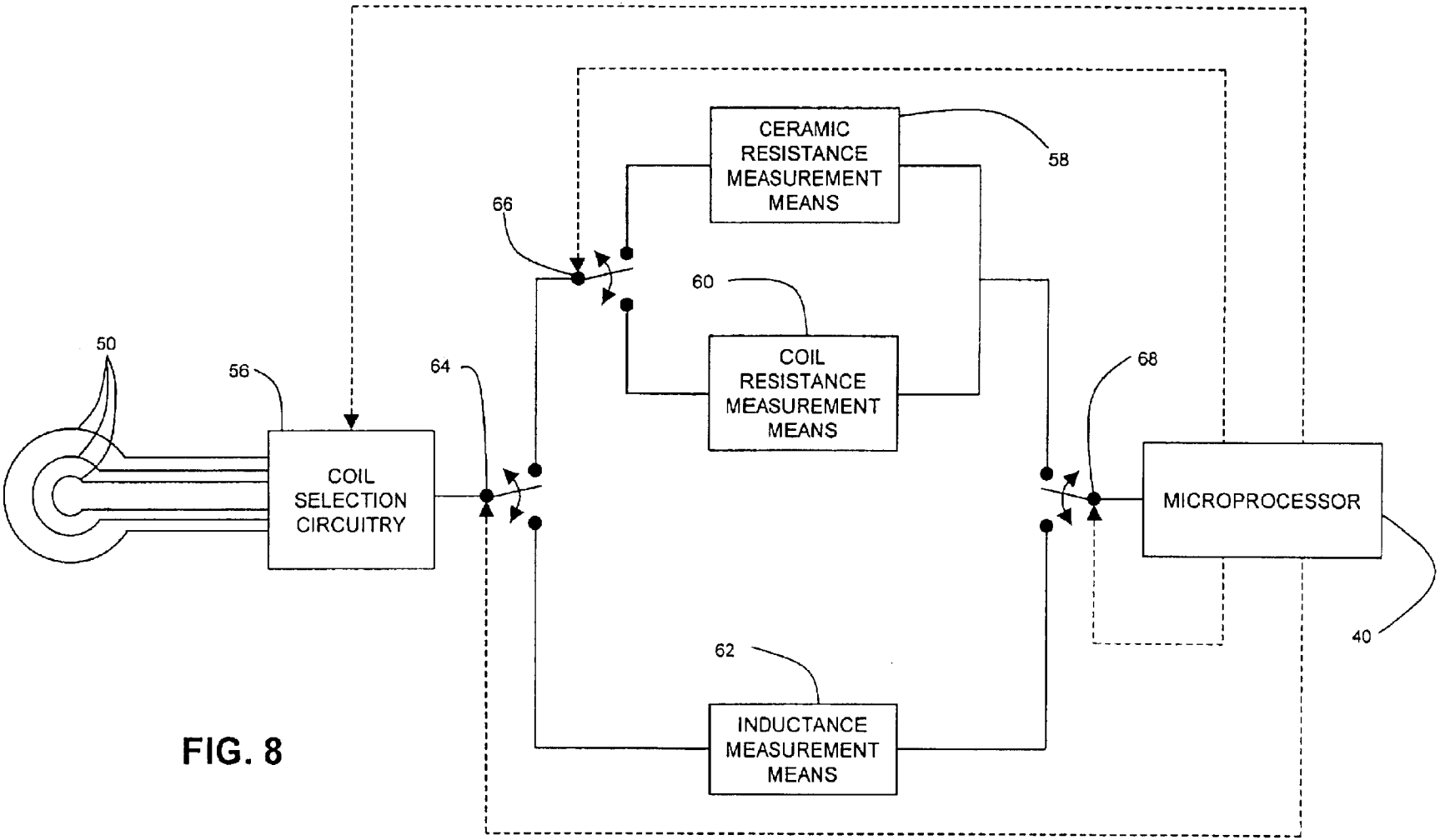
FIG. 8 is a schematic representation of a sensor interface architecture.

Referring to FIG. 8, the sensor interface architecture for the coils 50 is shown schematically. The interface architecture includes coil selection circuitry 56, ceramic resistance measurement means 58, coil resistance measurement means 60, and inductance measurement means 62. The coils 50 are all connected to coil selection circuitry 56. The coil selection circuitry 56 includes a number of relays controlled by the controller 40 that selectively switch between the various coils 50. That is, the coil selection circuitry 56 selects which coil is connected to the various measurement means. A first switch 64 is connected between the coil selection circuitry 56 and the three measurement means 58, 60 and 62. In a first state the first switch 64 connects the coil selection circuitry 56 to one of the resistance measurement means 58 and 60, and in a second state the first switch 64 connects the coil selection circuitry 56 to the inductance measurement means 62. A second switch 66 is connected between the first switch 64 and the two resistance measurement means 58 and 60. In a first state the second switch 66 connects the first switch 64 to the ceramic resistance measurement means 58, and in a second state the second switch 66 connects the first switch 64 to the coil resistance measurement means 60. A third switch 68 connects the appropriate measurement means to the controller 40 via an analog-to-digital interface (not shown). In a first state the third switch 68 connects one of the resistance measurement means 56 and 58 to the controller 40, and in a second state the third switch 68 connects the inductance measurement means 62 to the controller 40. Switching of the three switches 64, 66, 68 is controlled by the controller 40.

The ceramic resistance measurement means 58 measure the ceramic resistance between two given coils 50. One possible arrangement is an AC resistance divider network with different bias resistances for the different ranges of ceramic resistance corresponding to varying glass temperature (according to the well known inverse glass-ceramic resistance versus temperature characteristic) as is known in the art. The coil resistance measurement means 60 can be a simple DC resistance divider arrangement for measuring the intrinsic resistance of a selected coil. The inductance measurement means 62 can be an AC driven impedance bridge for measuring the inductance of a selected coil.

Using the interface architecture shown in FIG. 8, the three measurements of ceramic resistance, coil resistance and coil inductance can be measured successively by selecting the desired coils with the coil selection circuitry 56 and selecting the appropriate switch states under the control of the controller 40. In other words, the desired measurements can be multiplexed in time. This approach offers flexibility in the choice of sensor modality depending on the current cooktop automation feature of interest (e.g., boil detection, pan presence, etc.). Another possible architecture of the interface between the coils and the interface circuitry can be asymmetrical connections to the coils to provide off-axis sensitivity. For example, the coil selection circuitry can have center taps on each coil and switch to sense the top or bottom halves.

Figure 9:
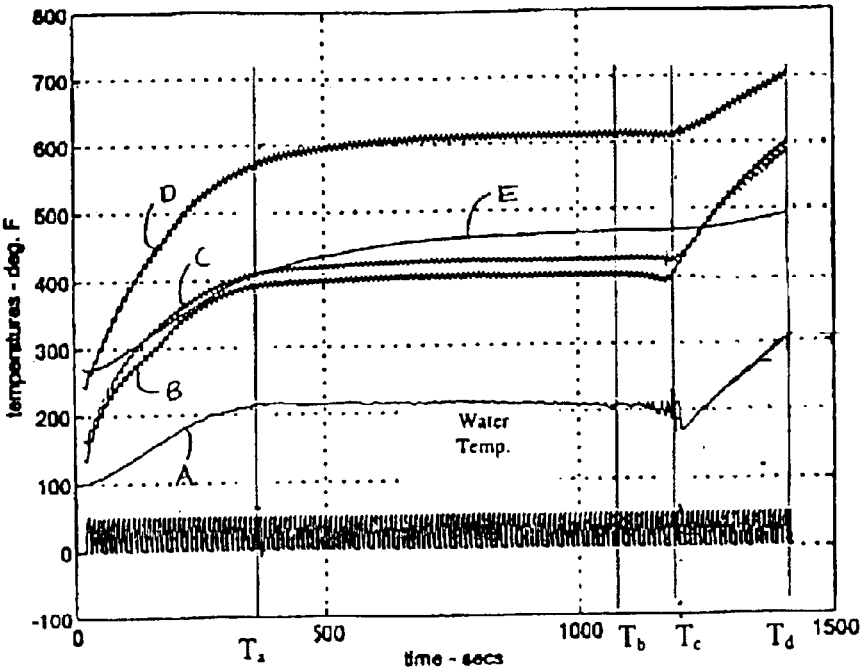
FIG. 9 is a graph plotting measured temperature of the glass-ceramic temperature as a function of time to illustrate rolling boil and boil dry detection.

In addition to measuring glass-ceramic plate temperature, the present invention is capable of measuring other cooktop related properties such as onset of rolling boil in a utensil, a boil dry state, and the presence or absence of a utensil on the cooktop. Rolling boil and boil dry detection is illustrated in FIG. 9, which plots temperature against time. FIG. 9 shows sensor signatures for the temperature sensing elements 30. Similar signatures would be obtained from the RTD elements or the coils with appropriate signal processing (signal conversion, smoothing, etc.).

In this example, a 1.5-quart aluminum pan with 200 ml of water in it is placed on the cooking surface and the burner is turned on. The pan is heated from a temperature below the boiling point of water up to a rolling boil and continuing into a boil dry condition (i.e., when all of the water has been boiled off). Thus, the glass-ceramic temperature begins at room temperature and rises steadily until the water comes to a boil at time $t_a$ (curve A represents the water temperature, curves B, C, D and E represent the respective sensor signatures for four thermocouples, During the boil phase, the water boils isothermally and heat is steadily removed via evaporation. With this steady heat removal, the glass-ceramic temperature and the pan temperature are approximately constant during this time interval. This is depicted in FIG. 9 by the plateau in the sensor signatures between time $t_a$ and time $t_b$ (curve E corresponds to a thermocouple radially located outside of the pan and thus does not have a similar signature). The water completely boils off at time $t_c$. At this point, there is a sudden drop in heat removal from the pan, and consequently, the glass-ceramic temperature increases rapidly. Thus, the plateau between times $t_a$ and $t_b$ is indicative of rolling boil, and the sharp rise beginning at time $t_c$ is indicative of a boil dry condition By measuring the gradient of the sensor output signals, the controller 40 can determine the onset of rolling boil and the boil dry condition.

Figure 10:
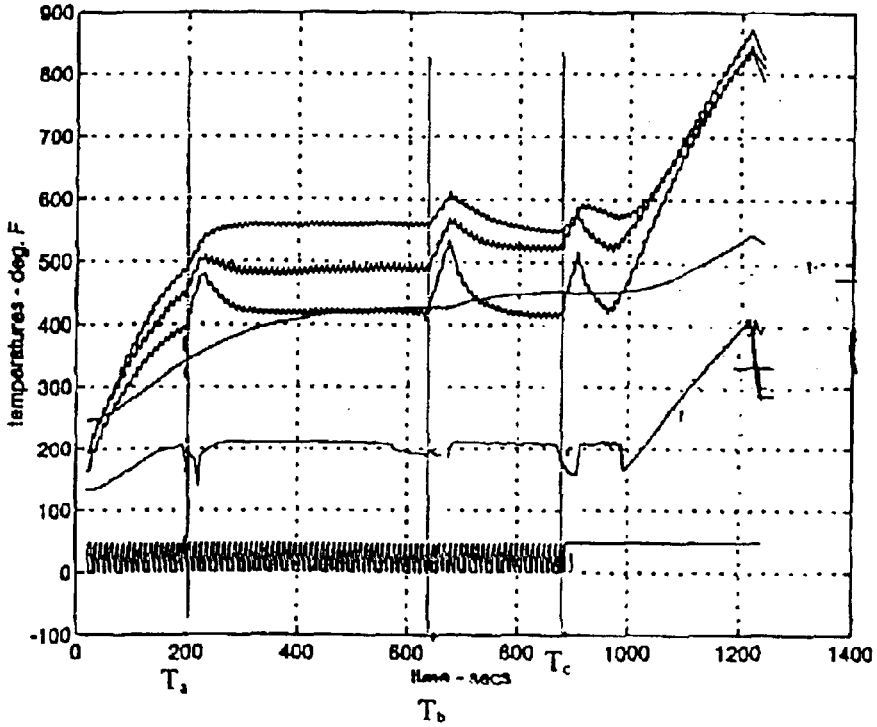
FIG. 10 is a graph plotting measured temperature of the glass-ceramic temperature as a function of time to illustrate utensil removal and placement detection.

Referring now to FIG. 10, utensil removal and utensil placement detection is illustrated. In the example of FIG. 10, the nominal boil sequence described above is repeated with the addition of the pan being removed and replaced at times $t_a$, $t_b$ and $t_c$. The glass-ceramic temperature shows a marked change at each time the pan is removed and replaced. Again, the controller 40 can use a simple gradient based detection scheme for utensil removal detection. For the inductive sensing coils 50, there are large differences in the inductances of the coils 50 with and without a (metallic) pan present on the burner. The inductance change is primarily due to the eddy currents induced in the pan by an AC excitation signal in the sensing loop. By monitoring these changes in inductance, the controller 40 can detect removal and replacement of the pan.

Figure 11:
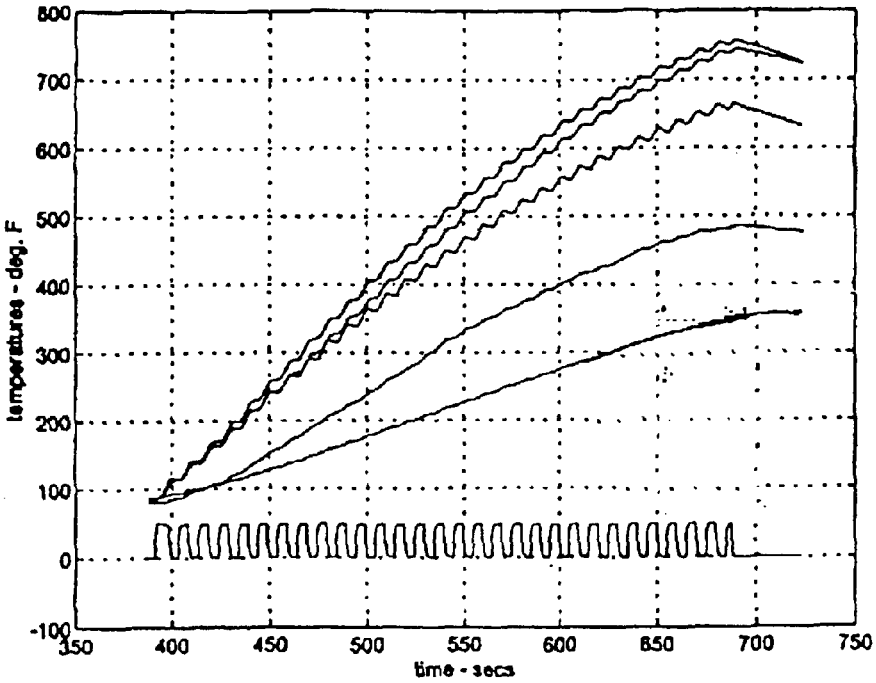
FIG. 11 is a graph plotting measured temperature of the glass-ceramic temperature as a function of time to illustrate utensil absence detection.

Utensil absence can be detected using a temperature measuring approach in that the temperature sensor signatures upon power up with and without a utensil present on the cooktop are different due to the different thermal masses of the loaded and unloaded cases. Thermocouple signatures in an unloaded case, shown in FIG. 11, do not show the plateau effect that occurs when a utensil is present. This difference can be used to detect utensil absence. Alternatively, utensil absence can be detected by monitoring inductance with coils 50.

While specific embodiments of the present invention have been described, it will be apparent to those skilled in the art that various modifications thereto can be made without departing from the spirit and scope of the invention as defined in the appended claims.

What is claimed is:

1. A sensor assembly for a glass-ceramic cooktop appliance having at least one burner assembly disposed under a glass-ceramic plate, said sensor assembly comprising:

a support bar mounted on said burner assembly adjacent to said glass-ceramic plate;

means for sensing cooktop related properties mounted on said support bar so as to be In contact with said glass-ceramic plate; and means for forcing said support bar toward said glass-ceramic plate.

2. The sensor assembly of claim 1 wherein said means for sensing comprises at least one discrete point temperature sensing element.

3. The sensor assembly of claim 2 wherein said means for sensing further comprises at least one inductive and temperature sensing coil.

4. The sensor assembly of claim 1 wherein said means for sensing comprises at least one resistance temperature device element.

5. The sensor assembly of claim 4 wherein said means for sensing further comprises at least one inductive and temperature sensing coil.

6. The sensor assembly of claim 1 wherein said means for sensing comprises at least one inductive and temperature sensing coil.

7. The sensor assembly of claim 1 wherein said support bar is made of the same glass-ceramic material as said glass-ceramic plate.

8. The sensor assembly of claim 1 wherein said support bar is made of a material having a similar thermal coefficient of expansion as said glass-ceramic plate.

9. The sensor assembly of claim 1 wherein said support bar comprises a plurality of spokes radiating outward from a cylinder.

10. The sensor assembly of claim 1 wherein said means for forcing said support bar toward said glass-ceramic plate includes a spring.

11. A glass-ceramic cooktop appliance comprising:

a glass-ceramic plate;

at least one burner assembly disposed under said glass-ceramic plate;

a support bar mounted on said burner assembly adjacent to said glass-ceramic plate;

means for sensing cooktop related properties mounted on said support bar so as to be in contact with said glass-ceramic plate; and means for forcing said support bar toward said glass-ceramic plate.

12. The glass-ceramic cooktop appliance of claim 11 wherein said means for sensing comprises at least one discrete point temperature sensing element.

13. The glass-ceramic cooktop appliance of claim 12 wherein said means for sensing further comprises at least one inductive and temperature sensing coil.

14. The glass-ceramic cooktop appliance of claim 11 wherein said means for sensing comprises at least one resistance temperature device element.

15. The glass-ceramic cooktop appliance of claim 14 wherein said means for sensing further comprises at least one inductive and temperature sensing coil.

16. The glass-ceramic cooktop appliance of claim 11 wherein said means for sensing comprises at least one inductive and temperature sensing coil.

17. The glass-ceramic cooktop appliance of claim 11 wherein said means for sensing comprises a plurality of inductive and temperature sensing coils.

18. The glass-ceramic cooktop appliance of claim 17 further comprising means for selecting one of said plurality of coils for measurement.

19. The glass-ceramic cooktop appliance of claim 18 further comprising:

means for measuring ceramic resistance between two of said coils;

means for measuring Intrinsic resistance of a selected one of said coils: and means for measuring inductance of a selected one of said coils.

20. The glass-ceramic cooktop appliance of claim 19 further comprising a plurality of switches for selectively connecting said coils to one of said means for measuring ceramic resistance, said means for measuring intrinsic resistance, and said means for measuring inductance.

21. The glass-ceramic cooktop appliance of claim 11 wherein said support bar is made of the same glass-ceramic material as said glass-ceramic plate.

22. The glass-ceramic cooktop appliance of claim 11 wherein said support bar Is made of a material having a similar thermal coefficient of expansion as said glass-ceramic plate.

23. The glass-ceramic cooktop appliance of claim 11 wherein said support bar comprises a plurality of spokes radiating outward from a cylinder.

24. The glass-ceramic cooktop appliance of claim 11 wherein said means for forcing said support bar toward said glass-ceramic plate includes a spring.

* * * * *